United States Patent [19]

Mott

[11] 4,026,362

[45] May 31, 1977

[54] SUBSURFACE WELL APPARATUS HAVING IMPROVED OPERATOR MEANS AND METHOD OF USING SAME

[75] Inventor: James D. Mott, Houston, Tex.

[73] Assignee: Hydril Company

[22] Filed: May 23, 1975

[21] Appl. No.: 580,241

[52] U.S. Cl. ..... 166/314; 166/322; 251/62

[51] Int. Cl.[2] ..... E21B 43/12

[58] Field of Search ..... 166/224 A, 72; 137/315, 137/629, 630; 251/58, 62

[56] References Cited

UNITED STATES PATENTS

| | | | |
|---|---|---|---|
| 3,744,564 | 7/1973 | Mott | 166/224 A |
| 3,762,471 | 10/1973 | Mott | 166/224 A |
| 3,763,933 | 10/1973 | Mott | 166/224 A |
| 3,854,502 | 12/1974 | Mott | 166/224 A |
| 3,856,083 | 12/1974 | Mott | 166/224 A |
| 3,858,650 | 1/1975 | Mott | 166/224 A |
| 3,901,321 | 8/1975 | Mott | 166/314 |

*Primary Examiner*—James A. Leppink
*Attorney, Agent, or Firm*—Pravel, Wilson & Gambrell

[57] ABSTRACT

A surface-controlled wire-line retrieval subsurface safety valve apparatus and method of utilizing the safety valve having a rotatable ball closure element and a movable operator mechanism that controls the operating stroke when the valve is operably installed as well as moving the ball and seat into sealing engagement.

17 Claims, 22 Drawing Figures

40
40f
46
40b
48a
46
48b
20c
40e
50
DR
40g
44
LR
40d
32c
24e
54a
52
32
54b
40c
32d
32b
24b
H
24a
60
24c
42
32e
24a
32h
34
32f
28b
32g
30
56
26
28
32
28d
32b
26
24
32a
28
28c
28a

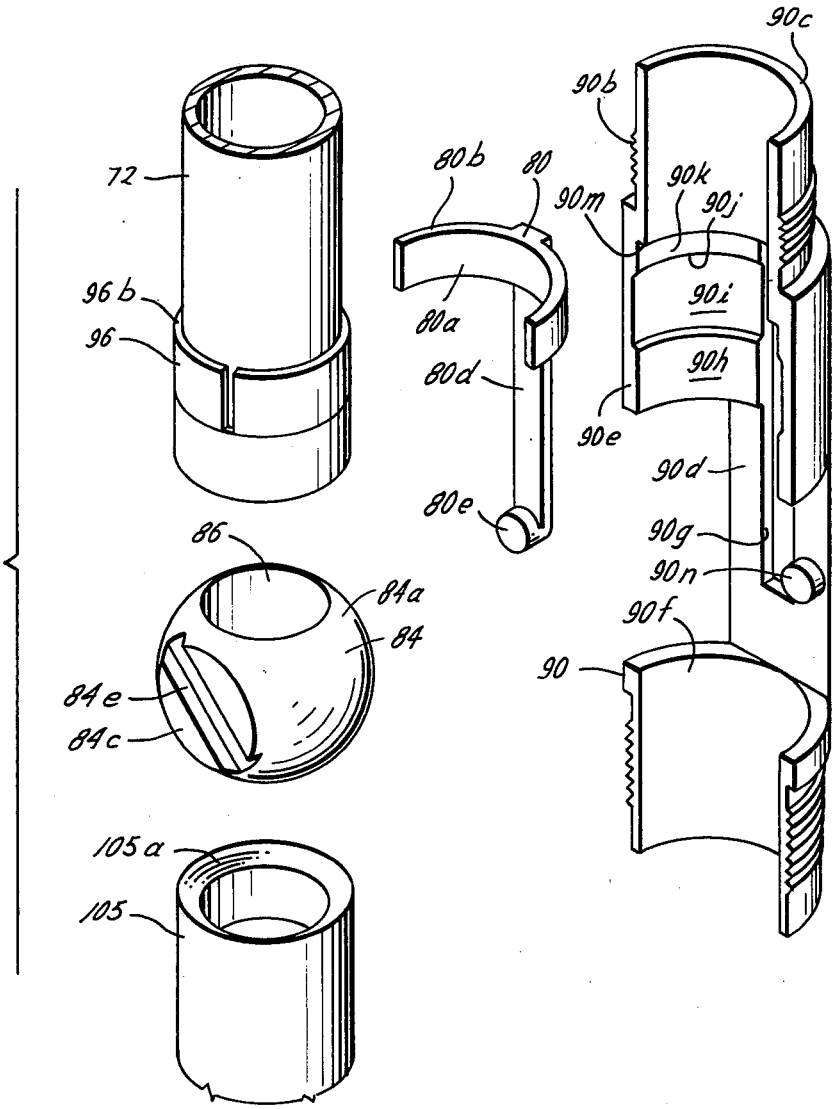
Fig. 11
Fig. 12
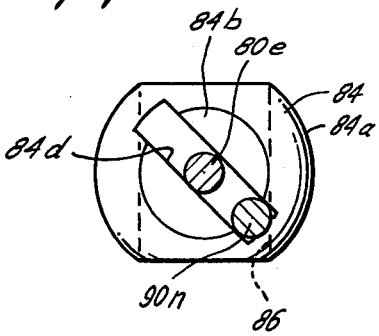
Fig. 13
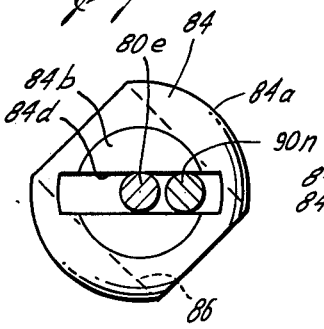
Fig. 14
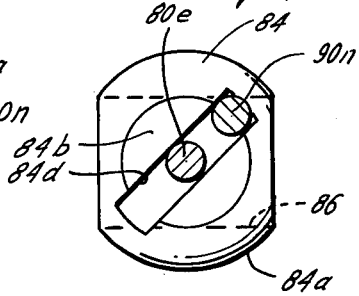

SUBSURFACE WELL APPARATUS HAVING IMPROVED OPERATOR MEANS AND METHOD OF USING SAME

CROSS REFERENCE TO RELATED APPLICATIONS

The disclosures of this patent application is related to the disclosures of the following patent applications filed concurrently herewith:

1. Mott application Ser. No. 580,228, filed May 23, 1975, and entitled "Subsurface Well Apparatus Having Flexing Means," and
2. Mott and Miyagishima application Ser. No. 580,240, filed May 23, 1975, and entitled "Subsurface Well Apparatus".

BACKGROUND OF THE INVENTION

This invention relates to the field of subsurface well apparatus and method for using same.

Subsurface safety valves are sometimes employed as catastrophic protection systems in wells for controlling flow of well fluids from the well producing formation at a subsurface location below the well head to avert well flow under disaster conditions or failure of the surface flow control systems. Operation of such subsurface safety valves may either be controlled by the well conditions—differential or ambient pressure—directly sensed by the valve at the subsurface location (direct-controlled) or controlled from the surface by a suitable control means (remote or surface-controlled). For a more detailed consideration of these types or categories of down hole or subsurface safety valves see the article entitled "Platform Safety by Down Hole Well Control" which appeared in the March 1972 issue of the *Journal of Petroleum Technology* published by the Society of Petroleum Engineers, Dallas, Tex.

Early examples of rotatable ball-type surface controlled subsurface safety valves include Knox U.S. Pat. No. 3,035,808, Fredd U.S. Pat. No. Re. 25,471 and Bostock U.S. Pat. No. 2,998,070. While these patents disclose the use of a rotatable ball-type flow closure element, other types of flow closure elements such as a flapper element as disclosed in Natho U.S. Pat. No. Re. 25,109 are also known. In general, these early surface-controlled subsurface safety valves were of the tubing retrievable type in that the upper and lower ends of the tubular valve housing were provided with means, normally threads, for connecting the valve housing in the production tubing and making the valve retrievable with the tubing, hence the designation of this type of valve as tubing retrievable. With a tubing retrievable type valve it is necessary to remove or pull the production tubing from the well in order to replace or repair the leaking or damaged valve and such tubing removal and installation operations are both expensive and hazardous and may result in permanent damage to the producing formation.

In order to overcome this problem with tubing retrievable valves, surface controlled wireline retrievable valves were developed such as disclosed in U.S. Pat. No. Re. 26,149 and U.S. Pat. No. 3,667,505. In general, these through-the-bore movable or wireline retrievable valves severely restricted the flow area through the valve due to the manner of their operation which required pressure responsive surfaces for the control fluid to be carried by the wireline retrievable valve.

Some attempts to overcome the disadvantages found in the prior art have used a combination of a surface-controlled tubing retrievable valve receiving and operating a wireline retrievable valve with the controls of the tubing retrieval when the tubing retrievable valve fails. U.S. Pat. No. 2,998,077 discloses the concept of locking a tubing retrievable valve open to conduct well operations through the valve while Canadian Pat. No. 955,915 and corresponding U.S. patent application Ser. No. 72,034, now abandoned, after filing continuation application Ser. No. 256,194 discloses the concept of releasably locking the tubing retrievable valve open. Such an arrangement is also disclosed in U.S. Pat. Nos. 3,696,868 and 3,868,995.

Mott U.S. Pat. No. 3,763,933 discloses the combination of a tubing retrievable valve and a wireline retrievable valve in which the wireline retrievable valve is operated off the controls of the tubing retrievable valve without the tubing retrievable valve being locked open.

Mott U.S. Pat. No. 3,762,471 also discloses a tubing retrievable valve that is locked open and the wireline retrievable valve operated off the controls of the tubing retrievable valve. That patent further disclosed the use of a movable landing ring for operably positioning the wireline retrievable valve in the tubing retrievable valve for releasably securing.

Mott U.S. Pat. No. 3,744,564 disclosed an improved wireline retrievable or drop-in valve in which the drop-in valve operator sleeve was secured with the reciprocating tubing operator of the tubing retrievable valve to assure positive operation of the wireline valve. The wireline retrievable valve disclosed in these three Mott patents considered immediately above and their divisional applications did not carry the pressure responsive surfaces and did provide for a ball closure element having a diameter substantially equal to the outer diameter of the wireline retrievable valve housing in order to increase the flow area through the wireline retrievable valve.

Mott U.S. Pat. No. 3,858,650 discloses a dual controlled tubing retrievable housing without a flow controlling valve element for receiving and operating the through-the-flowline retrievable valve disclosed in U.S. Pat. No. 3,744,564 with either control line.

SUMMARY OF THE INVENTION

A through the bore movable surface-controlled rotatable ball-type safety valve is provided with means for moving the ball and eat into sealing engagement upon initial movement of the bal to the closed position. The ball is connected to the valve frame to assume positive rotational operation upon initial valve closing longitudinal movement of the valve operator.

An object of the present invention is to provide a new and improved method of using a subsurface well apparatus.

Yet another object of the present invention is to provide a new and improved subsurface well apparatus and method of using the subsurface well apparatus.

A further object of the present invention is to provide a new and improved apparatus for controlling the operation of the flow control assembly.

BRIEF DESCRIPTION OF THE DRAWINGS

FIG. 11 is an exploded isometric view of the rotating ball element and one-half of the operating sleeve which is operably connected therewith; and FIGS. 12 through 14 are schematic views illustrating rotational movement of the ball element relative to the pivot pins as the ball element moves from the open position to an intermediate position and then to the closed position.

DESCRIPTION OF THE PREFERRED EMBODIMENT

Figure 1:
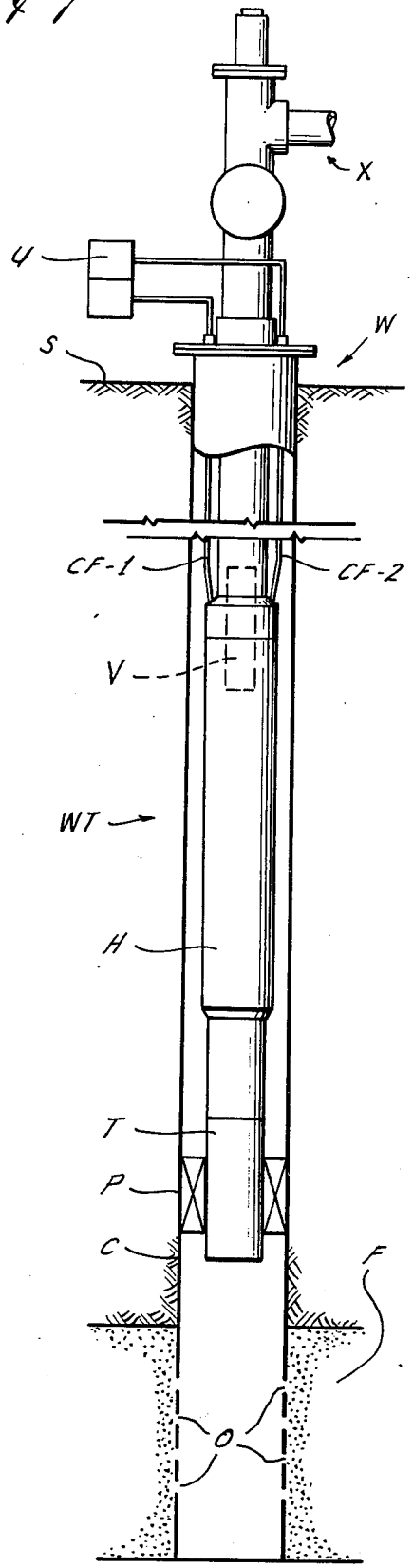
FIG. 1 is an elevation view, partly in section, of the well apparatus of the present invention connected in a production tubing in a well.

As illustrated in FIG. 1, the subsurface safety valve well tool apparatus, generally designated WT, is mounted in a production tubing T of a well W for controlling flow of well fluids to the surface S through the bore of the production tubing T. A packer P seals between the production tubing T and the inner surface the well casing C for forcing the well fluids into the bore of the production tubing P as is well known in the art. Well fluid flow is from a well formation F through the perforated openings O in the casing C and upward through the bore TB of the production tubing T to the surface S as is well known in the art. A christmas tree X at the surface S is normally used to control the flow of fluid through the bore of the production tubing T as is also well known in the art. A first control fluid conduit CF-1 connects the well tool WT with a typical control unit U located at the surface S while a second control fluid conduit CF-2 also connects another portion of the tool WT with the controller located remotely from the well W. It is to be understood that the invention as described herein is applicable for use in connection with flow control of wells W either drilled on dry land or in large bodies of water such that the surface S may well represent the ocean bottom.

The general preferred embodiment of the well tool apparatus WT of the present invention employs a tubing retrievable housing H forming a portion of the production or well tubing T for receiving and operating a through-the-bore movable valve tool V which is illustrated in phantom in FIG. 1.

The tubing retrievable housing may be of the type disclosed in U.S. Pat. Nos. 3,744,564 or 3,858,656 or the type disclosed herein as the preferred embodiment. The through-the-bore movable valve V of the present invention is an improvement of a similar through-the-bore movable flow control apparatus disclosed in U.S. Pat. No. 3,744,564. The valve V disclosed in that United States Patent differs from the valve V of the present invention in regard to the number of improvements found in the valve V of the present invention and not present in the earlier disclosed embodiment. In essence, the housing H receives the through-the-bore movable valve V for securing with the housing H in a manner to effect longitudinal movement of an operator of the valve V to enable remote-controlled operation of the valve V to control the flow of well fluids through the bore of the well tubing at the housing H.

Figure 2A:
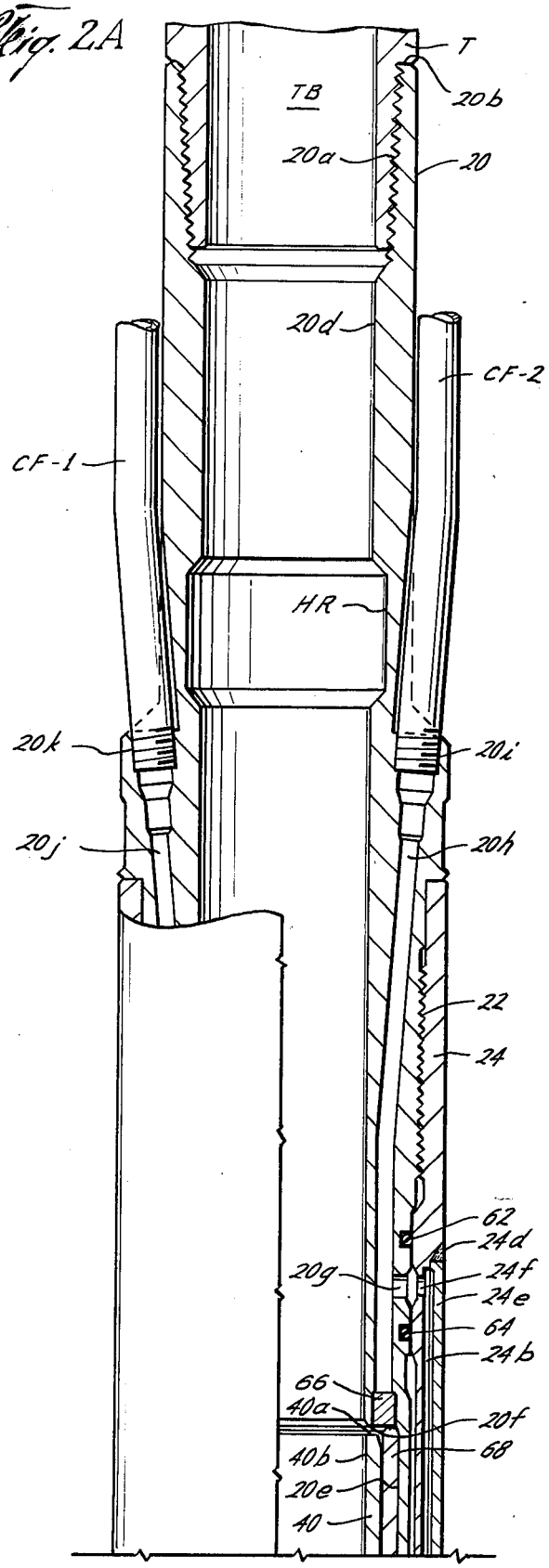
FIGS. 2A, 2B and 2C are elevations, partly in sections, from the upper to the lower end, respectively, of the tubing retrievable housing of the present invention.
Figures 2B, 2C:
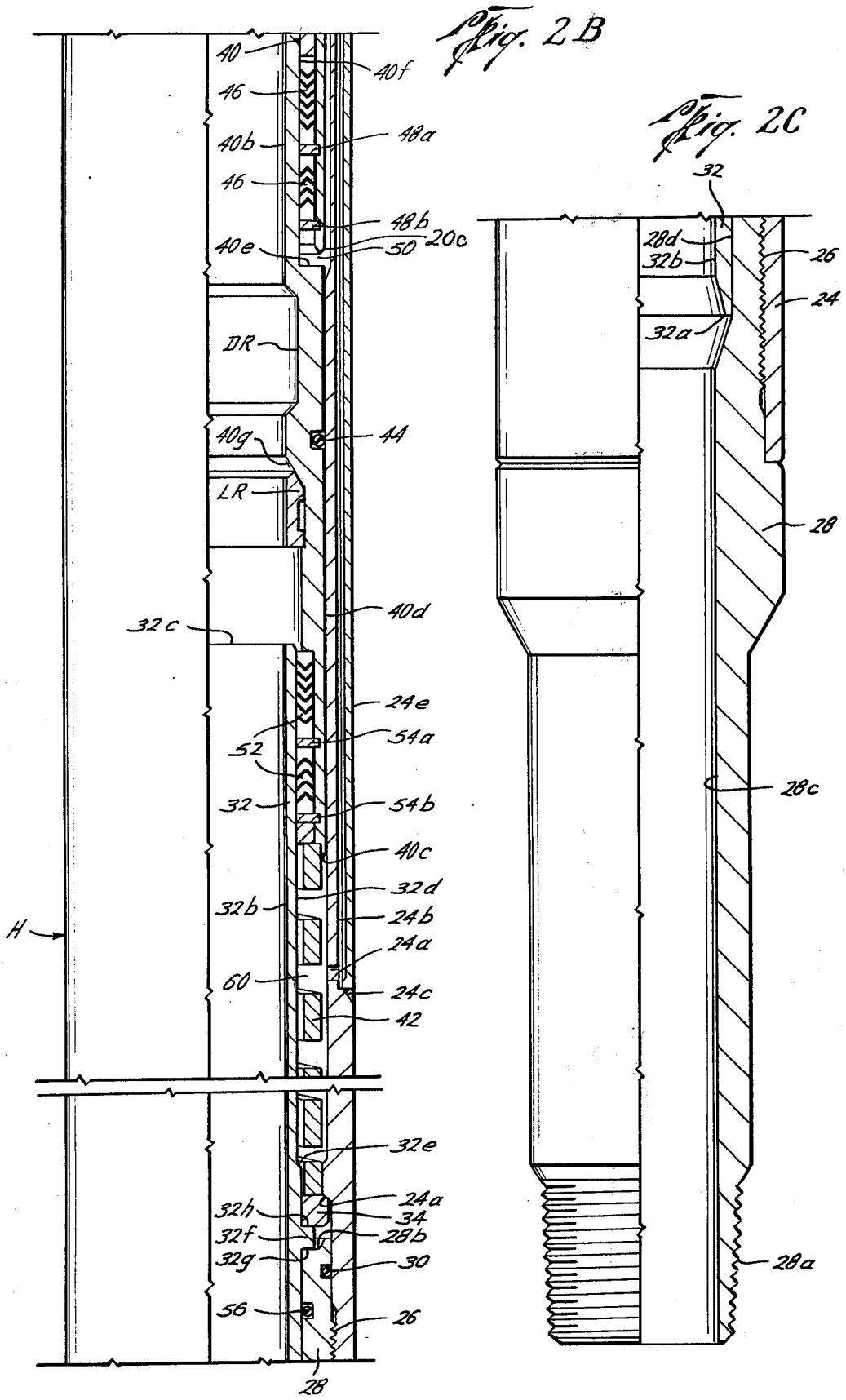

The housing H of the present invention is best illustrated in FIGS. 2A, 2B and 2C with FIG. 2A illustrating the upper portion of the housing H and FIG. 2C the lower portion of the housing H. For ease of assembly the tubular housing H is formed of three tubular portions comprising the upper tubular housing 20 threadedly connected at 22 with an intermediate housing portion or section 24. The intermediate housing portion 24 is in turn connected to a lower tubular housing portion 28 by threaded engagement at 26. The upper housing portion is provided with suitable means, such as box threads **20*a* for connection with the well or production tubing T above the housing H while the lower housing portion 28 carries suitable means such as pin threads 28*a*** for connecting with the well tubing T below the housing H. Thus the tubular housing H forms a portion of the well tubing T for conducting flow of well fluids from the producing formation F to the surface S.

The upper housing portion 20 terminates at its upper end in an upwardly facing annular shoulder **20*b* with the upper housing portion 20 extending downwardly from the shoulder 20*b* to a downwardly facing annular shoulder 20*c* (FIG. 2B). The tubular housing portion 20 forms an upper inner diameter surface 20*d* and a lower larger inner diameter surface 20*e* connected by downwardly facing shoulder 20*f*. The upper inner surface 20*d*** is provided with an annular recess HR for releasably securing the valve V with the housing H as will be set forth in detial hereinafter.

The lower tubular housing portion 28 terminates at its upper end in an upwardly facing annular shoulder **28*b* (FIG. 2B). The lower housing portion 28 carries an O-ring 30 for blocking leakage of fluid along the threaded engagement 26 with the intermediate housing portion 24. The lower housing portion 28 has a lower inner surface 28*c* having an upper enlarged inner surface portion 28*d* for receiving a tubular wash pipe 32** within the housing H.

The wash pipe 32 forms a downwardly facing annular shoulder **32*a* at its lower end which is positioned adjacent the threaded engagement 26 and which extends upwardly forming an inner surface 32*b* of substantially the same diameter as the surface 28*c* of the lower housing portion 28. The inner surface 32*b* terminates at an upwardly facing annular shoulder 32*c* forming the upper end of the wash pipe 32 and which forms a downwardly facing constant diameter outer sealing surface 32*d* that is stepped at 32*e* above outwardly projecting annular collar 32*f*. The collar 32*f* forms a downwardly facing annular shoulder 32*g* and an upwardly facing shoulder 32*h*. The downwardly facing annular shoulder 32*g* engages the upwardly facing locking shoulder 28*b*** of the lower housing portion 28 for blocking downward movement of the wash pipe 32. A ring shaped spring keeper 34 is disposed above the collar 32*f* in engagement with the upwardly facing annular shoulder 32*h*. The spring keeper 34 also engages a downwardly facing annular shoulder 24*a* for blocking upward movement of the spring keeper 34 and the wash pipe 32 relative to the tubular housing H. Thus the inner surface 32*b* of the wash pipe 32 and the inner surface 28*c* of the lower housing portion cooperate to form a well fluid flow passage through the lower portion of the housing H.

As illustrated in FIGS. 2A and 2B, a longitudinally movable tubular operator or valve control member 40 is mounted with the housing H. The control member 40 forms an upwardly facing annular shoulder 40*a* disposed adjacent the shoulder 20*f* of the upper housing portion 20 and which defines the upper end of the control member 40. The control member D forms an inner surface 40*b* which terminates at a downwardly facing annular shoulder 40*c* (FIG. 2B) defining the lower end of the control member 40. The downwardly facing annular shoulder 40*c* engages the upper end of a biasing or urging spring 42 disposed between the shoulder 40*c* and the spring keeper 34 for normally maintaining the control member D moved to the upper position illustrated in FIGS. 2A and 2B. Extending upwardly from the downwardly facing annular shoulder 40*c* is an outer constant diameter surface 40*d* that is disposed adjacent the intermediate housing portion 24. The control member D carries an O-ring or seal means 44 for blocking passage of fluids between the control member D and the intermediate housing portion 24 during longitudinal reciprocating movement of the control member 40.

The constant diameter outer surface 40*d* terminates at an upwardly facing pressure responsive annular shoulder surface 40*e* which terminates with an upwardly extending constant diameter outer surface 40*f* extending to the upper annular shoulder 40*a*. Chevron packing 46 mounted with the surface 20*e* of the upper housing portion 20 provides a seal means for blocking passage of fluid between the upper housing portion 20 and the control member 40 during reciprocating movement of the control member D. Snap rings 48*a* and 48*b* are secured with the upper housing portion 20 to block downward movement of the chevron packing 46.

The packing 46 and O-ring 44 cooperate to form a control fluid expansible chamber 50 in which the fluid pressure in the chamber 50 urges on the pressure responsive surface 40*e* of the control member 40 for urging the control member downwardly to overcome the upwardly biasing of the spring 42. The effective surface area of the pressure responsive surface 40*e* is of course the differential area of the seals effected by the O-ring 44 and the packing 46.

The control member 40 mounts chevron packing 52 adjacent the lower downwardly facing shoulder 40*c* when snap rings 54*a* and 54*b* secure the packing means 52 with the control member 40. The chevron packings 52 effects a sliding seal between the outer surface 32*d* of the wash pipe 32 and the control member 40.

The lower housing portion 28 mounts or carries an O-ring 56 adajcent the O-ring 30 for blocking flow of fluid between the wash pipe and the lower housing member 28. Thus the O-rings 30 and 56 cooperate with the packing 52 in the O-ring 44 to define an expansible balancing chamber 60. Fluid pressure in the chamber 60 urges upwardly on the downwardly facing annular shoulder 40*c* of the control member 40 for urging the control member 40 upwardly in conjunction with the spring 42 positioned therein. In order to equally offset the hydrostatic heads of the control fluid in the control fluid conduit CF-1 and CF-2, it is desirable that the pressure responsive surface area 40*c* be equal to the pressure responsive surface 40*e* for effecting downward movement of the control member 40 for offsetting or balancing the hydrostatic head or control fluid pressure in the control fluid conduits CF-1 and CF-2. Of course, one skilled in the art can vary the size of the pressure responsive areas to enable well fluid pressure to aid or oppose movement of the control member 40 in either direction.

Expansible chamber 60 communicates with the control fluid conduit CF-2 and the automatic controller U through the fluid passageway system now to be described. A port 24*a* of the intermediate housing portion 24 communicates with an internal channel 24*b* formed by welding such as illustrated at 24*c* and 24*d* a member 24*e* to enclose the channel 24*b* as is known. Adjacent the weld 24*d* (FIG. 2A) a port 24*f* is formed for communicating the channel 24*b* with a port 20*g* communicating with a channel 20*h* formed in the upper housing 20. The channel 20*h* communicates with the bore of the control fluid conduit CF-2 which is secured thereto by a suitable means such as threaded engagement at 20*i*. O-rings 62 and 64 disposed above and below the communicating ports 20*g* and 24*f* block leakage of the control fluid between the upper housing portion 20 and the intermediate housing portion 24.

The control fluid channel 20*h* is sealed at its lower end by receiving therein an annular seal ring 66 which is held in position by a spacer sleeve 68 disposed between the seal ring 66 and the upper chevron packing 46.

The operating expansible control fluid pressure chamber 50 communicates with the control fluid conduit CF-1 through the annular space between the upper housing portion 20 and the intermediate housing portion 24 to a location below the O-ring 64. Referring now to FIG. 9B, a port 24*g* of the intermediate housing portion communicates with a control fluid channel 20*j* which is in communication with the control fluid conduit CF-1 (FIG. 2A) and which is secured thereto by a suitable means such as threaded engagement at 20*k*. Thus, increased control fluid pressure communicated to the control fluid conduit CF-1 will be communicated into the expansible chamber 50 for urging the control member 40 to move downwardly while the control fluid pressure in the chamber 60 will resist such downward movement. By venting the control fluid conduit CF-2 while applying control fluid pressure CF-1 to move the control member 40 downwardly the increased control fluid pressure required in the control fluid conduit CF-1 will only be the pressure required to overcome the urging of the spring 42. The hydrostatic head of the control fluid in each of the control lines CF-1 and CF-2 will be offset in such operations and such offsetting or balancing enables the running of the tubing retrievable housing H at greater depths in the well and which is a desirable feature.

As best illustrated in FIG. 2B the inner surface 40*b* of the operator or control member 40 is provided with an annular recess DR and a downwardly facing tapered shoulder 40*g* immediately above a landing ring LR. The landing ring LR is a split radially contractable member that may be forced to move inwardly by the control member 40 moving downwardly to engage the landing ring LR with the upwardly facing annular shoulder 32*c* of the wash pipe in order to wedge the landing ring LR to move radially inwardly with the downwardly facing annular shoulder 40*g*, (FIG. 7B). As set forth in U.S. Pat. No. 3,762,471, the landing ring LR is moved into the bore of the tubing retrievable housing H to position the safety valve V therein for securing.

Figure 3A:
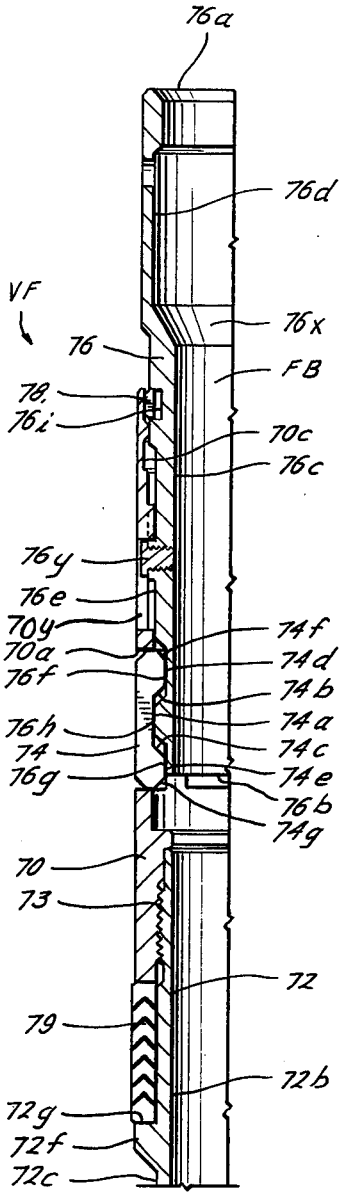
FIGS. 3A and 3B are half-section elevation views illustrating the wire-line retrievable valve of the present invention in the configuration which it is more through the bore of the tubing to the tubing retrievable housing.
Figure 3B:
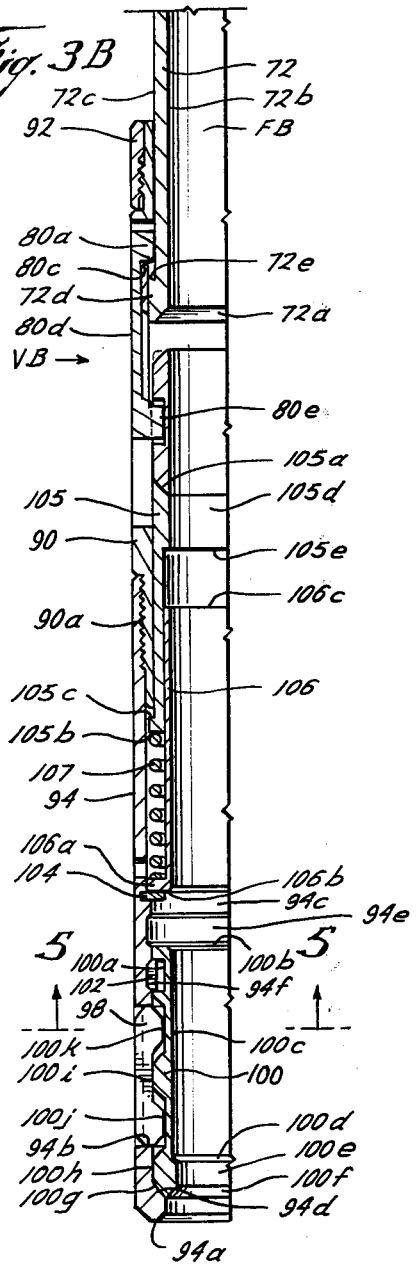

Referring now to FIGS. 3A and 3B which illustrate the through-the-bore movable valve V in alphabetical sequence from top to bottom, the valve V will be described in detail. The valve means V of the present invention may be considered as comprising a frame means, generally designated VF, carrying a bore closure means, generally designated VB and an operator means, generally designated VO, that is operably connected with the bore closure means for effecting controlled operation of the bore closure means B.

The frame means VF is preferably formed of a plurality of substantially tubular members connected for ease of assembly to form a substantially tubular unit or assembly that extends downwardly from the upper portion of the valve V to a location below the bore closure means VB. In the disclosed preferred embodiment, an upper main frame sleeve 70 is connected to a frame sealing sleeve 72 by threaded engagement at 73.

Figure 4A:
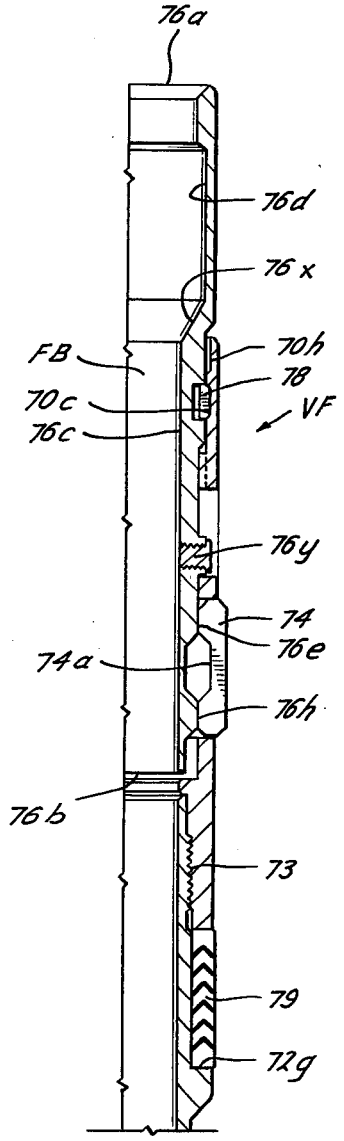
FIGS. 4A and 4B are elevations similar to FIGS. 3A and 3B with the valve in the closed position and the releasable locking means are in the locked position.

The safety valve V include means for releasably securing with the housing H that are disclosed as provided by a plurality of latch dogs 74 to be received within the housing recess HR and a frame latch sleeve 76. The plurality of four dogs 74 are preferably movably disposed in a plurality of four equi-circumferentially spaced windows 70*a* formed in the frame sleeve 70 and which are radially movable from the released or inner position (FIGS. 3A and 7A) to a locking or extending position (FIGS. 4A and 9A) where they are received in the annular recess HR formed in the bore of the housing H for blocking movement through the bore of the well tubing S. Each of the dogs 74 is provided with a central inner recess 74*a* having tapered upper and lower recess wedging surfaces or edges 74*b* and 74*c*, respectively, leading to dog latching or locking surfaces 74*d* and 74*e*, respectively, and which are provided with tapered outer wedging shoulders 74*f* and 74*g*, respectively. Outwardly projecting tapered side flanges (not illustrated) prevent each of the dogs 74 from moving out of the respective windows 74*a* and serve as a movement limit stop for the outwardly extending dogs 74 in the locking position.

The frame latch sleeve 76 is longitudinal movable relative to the frame sleeve 70 and is disposed within the sleeve 70. The latch sleeve 76 extends downwardly from an upwardly facing annular shoulder 76*a* to a downwardly facing annular shoulder 76*b* adjacent the lower portion of the latch dogs 74 when the frame latch sleeve 76 is in the upper position illustrated in FIG. 3A. The tubular latch sleeve 76 includes an inner or bore defining surface 76*c* having an operating or releasing recess 76*d* formed therein and an upwardly facing lock actuating shoulder. When the latch sleeve 76 in the upper or latched dog release position recesses 76*f* and 76*g* formed in the outer surface 76*e* are positioned adjacent locking surfaces 74*d* and 74*e*, respectively, of the latch dog in order that the latch dogs may move radially inwardly. Disposed between the recesses 76*f* and 76*g* is a locking surface 76*h* that is a companion locking surface to that formed by the outer surface 76*e* immediately above the recess 76*f*. When the latch sleeve 76 moves to the lower or latch dog locking position relative to the frame 70 (FIG. 4A) the tapered edges of the recesses 76*f* and 76*g* wedge or force the latch dogs 74 radially outward as the locking surfaces 76*h* and 76*e* move downwardly relative to the dogs 74 to be positioned adjacent the locking surfaces 74*e* and 74*d* of the latch dogs 74, respectively, for latching the dogs 74 in the locking position.

The latch sleeve 76 is movably connected with the frame sleeve 70 by a suitable means to enable the desired reciprocating movement of the latch sleeve 76 relative to the frame sleeve 70 to effect movement between the released and latched or locking position. In the embodiment illustrated in FIG. 3A a threaded pin 76*y* forms an extension riding in a longitudinal groove 70*y* cut in the main frame 70 and which arrangement is disclosed in U.S. Pat. No. 3,744,564 and to which reference has been made for incorporating that disclosure herein. The latch sleeve 76 carrises a radially expansible detent split ring 78 in a recess 76*i* formed on the outer surface 76*e* of the latch sleeve 76. When the latch sleeve 76 is in the upper position the detent 78 is in the position illustrated in FIG. 3A where it engages an upwardly facing tapered annular shoulder 70*b* to prevent inadvertent downward movement of the latching position and when the latching sleeve 76 moves to the lower of latching position the detent ring 78 is radially constricted until adjacent a latching recess 70*c* and into which the detent 78 expands to prevent inadvertent movement of the latching sleeve 76 from the latched position.

The sealing sleeve 72 extends downwardly from the threaded connection at 73 (FIG. 3A) to a downwardly facing arcuate sealing shoulder or seat 72*a*. An inner surface 72*b* of the sleeve 72 as well as the inner surface 76*c* of the latch sleeve 76 define a frame bore FB forming a flow passage through the valve frame means VF for the well fluid. The sealing frame 72 forms an outer surface 72*c* having an outwardly projecting collar 72*d* adjacent the seat 72*a*. The collar 72*d* forms an upwardly facing annular shoulder 72*e* for securing a ball connecting member 80 withe the sleeve 72. The outer sleeve 72*c* forms a second outwardly projecting collar 72*f* adjacent the threaded engagement at 73. The collar 72 forms an upwardly facing annular shoulder 72*g* securing chevron packing 79 with the sealing member 72. The packing 79 blocks the passage of well fluid between the frame sealing sleeve 72 and the housing H to force the well fluids to flow through the frame bore FB in flowing from the producing formation through the well tubing T to the surface S.

The ball connecting member 80 is connected with and extends downwardly from the sealing frame 72 and may be best described as a longitudinally bisected or split ring unit having a pair of downwardly extending fingers which connect with the valve bore closure means VB. As the ball connecting member is formed of identical halves, only one half 80 will be described but it is to be understood that two halves are utilized in the present invention. The half referenced as 80 is best illustrated in FIG. 11. The upper ring portion 80*a* provides an upwardly facing annular shoulder 80*b* and a downwardly facing annular shoulder 80*c* which rest on the upwardly facing annular shoulder 72*e* of the collar 72*d* for connecting the ball connecting member 80 with the sealing frame 72. A longitudinally extending finger 80*d* is secure to the ring 80 and extends downwardly to terminate at inwardly projecting pivot pin 80*e*. The mating ball connector is provided with the identical parts and the reference number 81 is used to designate the identical part in the figures with the alphabetical reference characters designating identical portions to that of the ball connecting member 80.

The plug or bore closure means VB is disposed within the connecting members 80 and 81 and preferably includes a rotatable ball member 84 having an opening 86 formed therethrough. As is best illustrated in FIG. 11, the ball member 84 is formed with an outer spherical surface 84*a* and a pair of parallel chordal flats 84*b* and 84*c* as is well known in the art. Each of the circular chordal flats 84*b* and 84*c* are provided with a recess 84*d* and 84*e*, respectively, for receiving the inwardly projecting pins 80*e* and 81*e*, respectively, carried by the fingers 80 and 81 for mounting the ball 84 with the frame sleeve 72.

Figure 4B:
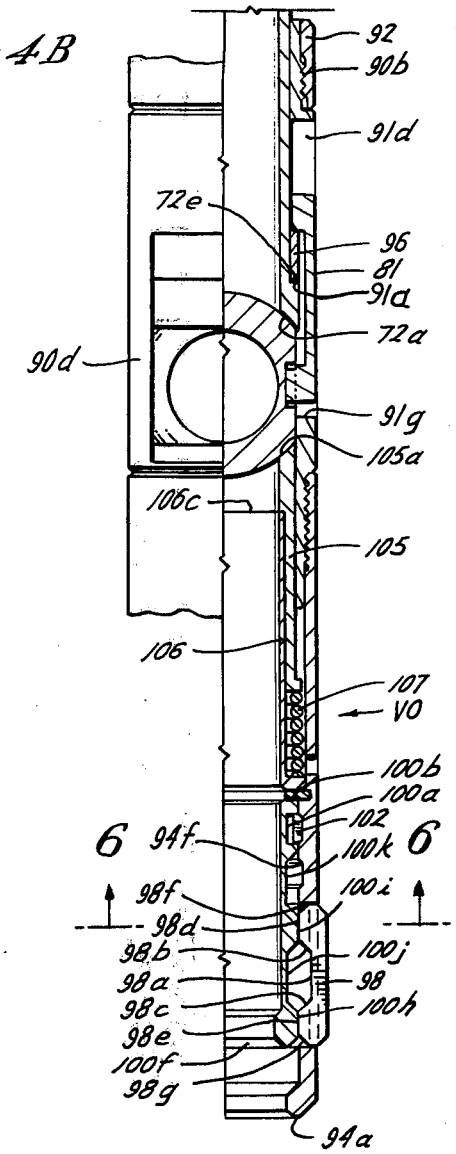

The ball 84 is rotatable to and from a first or open position with the flow opening 86 aligned with the bore FB of the frame means VF to enable flow of fluid through the safety valve V and a closed position with the opening 86 disposed substantially traversed and out of communication with the bore FB of the frame means F in order that the ball 84 and the seat 72*a* will serve to block flow of fluid through the valve V. The opening 86 is preferably formed of substantially the same diameter as the diameter of the frame bore FB in order to provide as large a flow opening through the safety valve V as possible. To further enhance this feature, the outer spherical surface 84*a* of the ball is formed of a diameter substantially equal to the outer diameter of the frame means VF and which is best illustrated in FIG. 4B.

The opertor means VO effects opening and closing rotation of the ball 84 and extends downwardly from a location above the ball 84 to the lower end of the valve V. The operator means includes a ball moving member 90 disposed adjacent to and movable relative to the ball connecting member 80. As best illustrated in FIG. 11, the ball moving member 90 is a longitudinally bisected or split sleeve unit that extends downwardly from above the ball connecting member 80 to connect with the operator sleeve or member 94 by threaded engagement at 90*a*. As with the ball fingers 80 and 81 the reference numeral 91 will be reserved for the mating half of the ball moving member 90 and which are substantially identical. Threads 90*b* are formed on the member adjacent the upper annular shoulder 90*c* for threadedly connecting with securing ring 92 for holding the sleeve halves 90 and 91 together for moving as a unit relative to the ball 84. The operator member 94 also serves to secure the sleeve sections 90 and 91 for moving as a unit relative to the ball 84. The ball moving member 90 has a substantial portion removed intermediate of the threads 90*a* and 90*b* to form a longitudinally extending finger 90*d* for connecting an upper ring or collar portion 90*e* with a lower ring or collar portion 90*f*. The finger 94 is slotted at 90*d* to receive the downwardly extending finger 80*d* of the ball connecting member 80. The finger 90*d* engages the ring 80*a* of the ball connecting member 80 for preventing radially outwardly movement of the connecting member 80 through the slot 90*g*. The space between the fingers 90*d* and 91*d* form windows for enabling the use of a large diameter ball as in discloed in U.S. Pat. No. 3,870,102.

The upper portion 90*e* of the ball moving member 90 forms an inner surface 90*h* having an enlarged annular recess 90*i* formed therein which terminates at its upper portion in a tapered annular shoulder 90*j* leading ot a ball cage ring retainer recess 90*k* having downwardly facing annular shoulder 90*m*. The slot 9*g* extends upwardly to the downwardly facing shoulder 90*m*· for providing clearance for the finger 80*d*.

In FIG. 11 a radially contractable detent ring 96 is illustrated mounted contracted on the frame 72 by engaging the upwardly facing annular shoulder 72*e* of the frame with a downwardly facing shoulder 96*a* of the detent ring. When the detent ring 96 is in the position illustrated in FIG. 11 an upwardly facing annular shoulder 96*b* engages the downwardly facing annular shoulder 80*c* of the ball keeper 80 for locating the ball keeper ring in the position illustrated in FIG. 4B. When the safety valve V is moving through the bore of the well tubing T to the subsurface location for securing it is in the stretched condition illustrated in FIG. 3B with the detent ring 96 positioned outwardly of the collar 72*d*. The initial closing of the ball 84 will move the ball 84 upwardly to engage the seat 72*a* and moving the ring portion 80*a* upwardly a sufficient distance above the shoulder 72*d* to enable the detent ring 96 moving upwardly with the ball cage 80 to radially constrict and seat the lower annular shoulder 96*a* on the upwardly facing annular shoulder 72*e* of the frame sleeve 72.

By inserting the detent 96 between the spaced shoulders 72*e* and 80*c* the outer spherical sealing surface 84 of the ball 84 is held in engagement with the seat 72*a*. In addition, the detent 96 eliminates the lost motion slack in the operator means VO that is required to insure proper positioning of the operator latch dogs in the recess DR and the latch dogs 74 in the housing recess HR. Obviously, to insure successful latching both recesses, HR and DR, must be slightly larger than the dogs being received therein to insure that the dogs will have sufficient clearance to move radially outwardly into the recess. This clearance provides a certain amount of slack which is compensated for by the detent 96 moving to modify or adjust the operating stroke by removing the slack between the securing detects 74 with the frame and the latch dogs mounted with the operator member 94 and which operator stroke adjustment operation insures that the downward movement of the control member 40 will positively pull the operator means VO downwardly to effect opening rotation of the ball 40 without the necessity of the control member 40 moving downwardly the distance required to effect radial constriction of the landing ring LR. The effective life of the landing ring LR is increased and thereby greatly enhancing the reliability of the safety valve system of the present invention.

The sleeve section 90 mounts an inwardly projecting eccentric ball pivoting or rotating pin 90*n* that is received within the slot 84*d* of the ball 84 while a similar eccentric pin is mounted with the section 91, but is located to be directly across the ball 84 from the pin 90*n* so both eccentric pins engage the ball 84 on the same longitudinal axis for imparting the rotating movement to the ball 84. When the ball moving member 90 is in the lower position and the ball 84 is in the open position (FIG. 12) the eccentric pins are disposed below the concentric pins 80*e*, but as the member 90 moves the eccentric pins upwardly the ball 84 commences (FIG. 13) to rotate to the closed position (FIG. 14).

Figure 5:
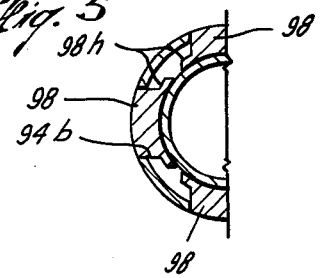
FIG. 5 is a view taken along line 5—5 of FIG. 3B.
Figure 6:
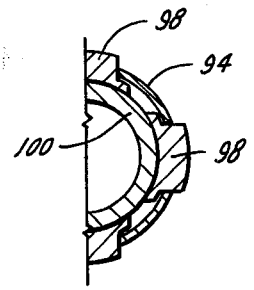
FIG. 6 is a view taken along line 6—6 of FIG. 4B.

As illustrated in FIG. 3B, the operator sleeve 94 extends downwardly from threaded engagement at 90*a* to the lower end of the valve V where it forms a downwardly facing annular shoulder 94*a* for engaging the landing ring LR for operably positioning the valve V in the housing H. The operator sleeve 94 has a plurality of four rectangular windows equi-circumferentially spaced adjacent the downwardly facing annular shoulder 94*a*. Each of the windows 94*b* receives a movable latch dot 98 similar to the latch dogs 74 movably disposed in the windows 70*a* of the frame sleeve 70. In FIGS. 5 and 6, the movement limiting flanges 98*h* of the dogs 98 are shown and the alphabetical reference characters enployed with the latch dogs 98 are identical to the alphabetical reference characters of the latch dogs 74 and reference is made to the earlier disclosures describing the similar structure and operation of the latch dog 98 which are received within the recess DR of the control member D for effecting longitudinal movement of the operator sleeves 94 and 90.

The operator latch sleeve 100 cooperates with the latch dogs 98 to accomplish the same result as the latch sleeve 76 effects with the latch dogs 74, but the operating positions of the latch sleeve 100 is reversed from the positions of the latch sleeve 76.

When the latch sleeve 100 is in the lower or released position (FIG. 3B) the dogs 98 are enabled to move radially inwardly, but when the latch sleeve 100 moves to the upper position relative to the operator sleeve 94 (FIG. 4B) the latch dogs 98 are wedged radially outwardly to the locking position for securing the operator sleeve 94 with the control member 40 for effecting the longitudinal reciprocating movement of the operator means VO. Referring now to FIG. 3B, the operator sleeve 94 forms an inner surface 94*c* having an upwardly facing annular shoulder 94*d* located below the windows 94*b* for providing a lower movement stop for the operator latch sleeve 100. The inner surface 94*c* forms a pair of spaced annular recesses 94*e* and 94*f* for alternately receiving a detent 102 carried by the operator latch sleeve 100 in a recess 100*a* to prevent inadvertent shifting of the sleeve 100 in the same manner that detent 78 does with latch sleeve 76.

Above the recess 100*a* the operator latch sleeve 100 forms an upwardly facing annular surface 100*b* for engaging a snap ring keeper 104 secured with the tubular member 94 for providing an upper limit stop for the latch sleeve 100 in the upper position and an inner surface 100*c* extends downwardly from the upper shoulder 100*b* to an inwardly projecting upwardly facing annular shoulder 100*d* formed by collar 100*e*. The collar 100*e* also forms a downwardly facing shoulder 100*f* leading to downwardly facing shoulder 100*g*. The shoulder 100*g* engages the upwardly facing shoulder 94*d* of the operator sleeve 94 to serve as the lower limit stop for the operator latch sleeve 100. Disposed above the shoulder 100*g* is a lower locking surface 100*h* spaced from upper locking surface 100*i* by a tapered recess 100*j*. A second releasing recess 100*k* is disposed above the locking shoulder 100*i*. The recesses 100*k* and 100*j* are aligned with the locking surfaces 98*d* and 98*e*, respectively, when the operator latch sleeve 100 is in the lower position for enabling the latch dogs 98 to move radially inwardly and when the operator latch sleeve 100 moves to the upper position (FIG. 4B) the locking surface 100*i* and 100*h* are moved for engaging the locking surfaces 98*d* and 98*e*, respectively, of the latch dogs 98 for moving the latch dogs radially outwardly and locking the latch dogs 98 in the extended locking position.

Above the keeper 104, the bore closure means VB provides a spring biased ball follower assembly comprising a ball follower 105 movably disposed in flow tube 106 and urged by the spring 107 to engage the spherical surface 84*a* of the ball 84 with an upwardly facing arcuate shoulder 105*a*. The flow tube 106 forms an outwardly projecting collar 106*a* adjacent a lower annular shoulder 106*b* engaging the keeper 104. The spring 107 is supported on the collar and urges upwardly on the downwardly facing annular shoulder 105*b* of the follower 105 for urging the follower 105 and the ball 84 upwardly into engagement with the sealing seat 72*a*. The follower is provided with an outwardly projecting lower collar 105*c* adjacent shoulder 105*b* which engages the ball moving member 90 to limit upward movement while an inwardly projecting collar 105*d* adjacent the upper shoulder 105*a* forms a downwardly facing shoulder 105*e* that engages an upwardly facing shoulder 106*c* of the flow tube 106 to limit downward movement of the follower 105.

Figure 7A:
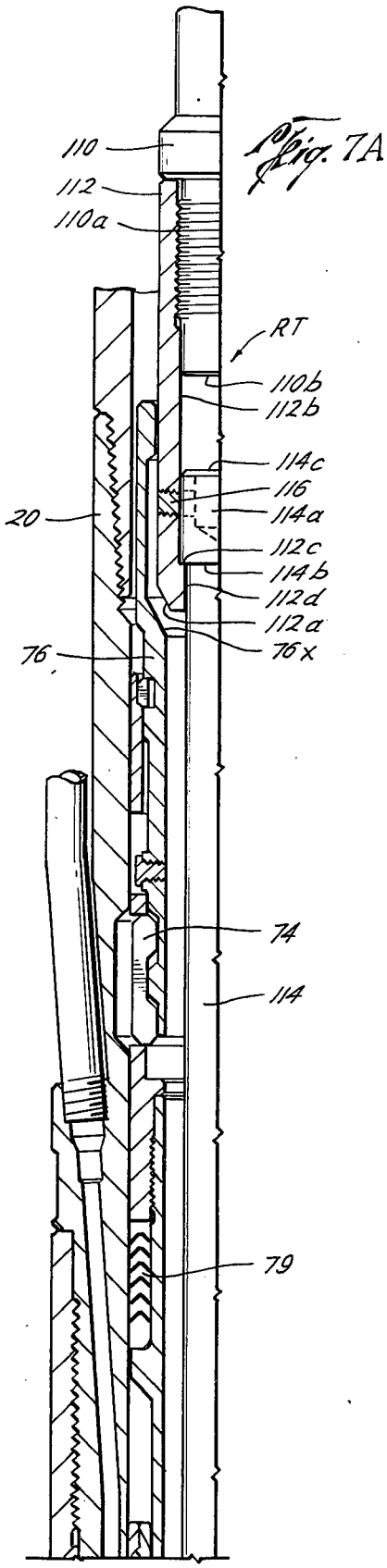
FIG. 7A and 7B are elevations, in section, showing the valve of FIGS. 3A and 3B assembled on a running tool moving into the tubing retrieval housing of FIGS. 1A, 1B and 1C.
Figure 7B:
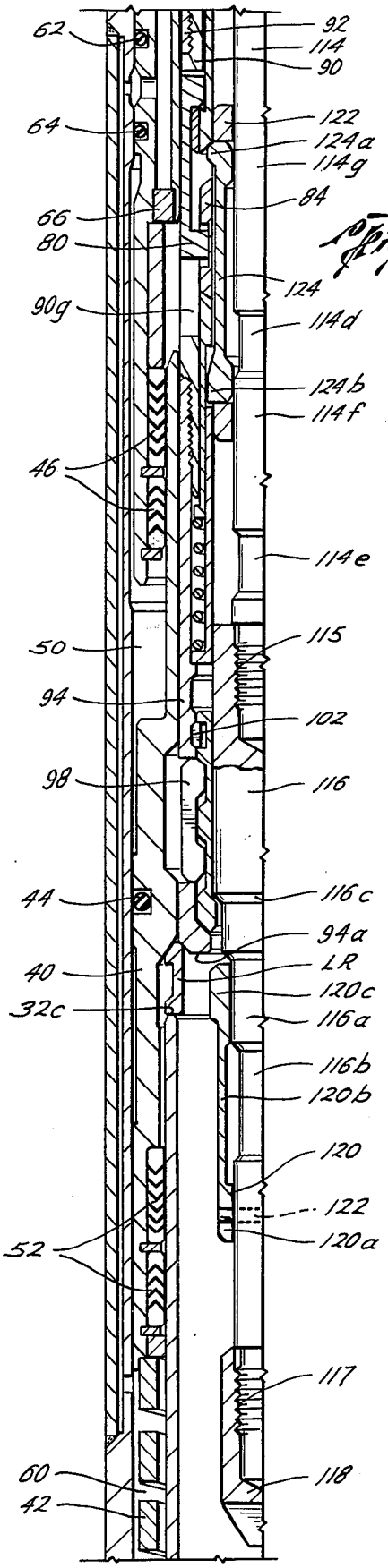

An installation or running tool for installing the safety valve V of the present invention in the housing H is illustrated in FIGS. 7A and 7B operably mounting with the subsurface safety valve V in the stretched condition. Essentially the running tool, generally designated RT, is provided with the longitudinal extending central body that extends through the subsurface safety valve to effect operation of the frame latch sleeve 76 and the operator latch sleeve 100 for operably securing the safety valve V in the housing H.

The running tool RT includes a connecting member 110 for connecting with the jars and wireline to effect operation of the running tool RT for securing the safety valve V in the housing H. Threadedly connected to the lower portion of the connecting member 110 at threads 110*a* is a locking sleeve 112 which extends downwardly to form a downwardly facing tapered annular locking shoulder surface 112*a* adapted to engage the upwardly facing tapered locking shoulder 76*x* of the frame latch sleeve 76. An inner surface 112*b* of the member 112 forms an upwardly facing shoulder 112*c* adjacent a reduced diameter inner portion 112*d*. Received within the tubular member 112 adjacent the surface 112*b* is an enlarged head 114*a* of an extension rod 114. The enlarged head 114*a* forms a downwardly facing annular shoulder 114*b* engaging the upwardly facing shoulder 112*c* for connecting the extension rod 114 with the tubular member 112. A shear pin 116 connects the head 114*a* and the tubular member 112 in the position illustrated and until the shear pin 116 is sheared an upwardly facing annular surface 114*c* of the extension head enlargement 114*a* is held spaced from the downwardly facing shoulder 110*b* of the member 110. The extension 114 is threadedly connected at 115 with a lower running tool body extension 116 which is turn is connected with a running tool nose 118 by threaded engagement at 117. Mounted on the lower running tool body 116 is a movable collet 120 having a lower collet ring ring body 120*a* and a plurality of upwardly projecting resilient fingers 120*b* mounting locking enlargements or bosses 120*c*. The bosses 120*c*. The bosses 120*c* are held adjacent a locking surface 116*a* of the member 116 by a shear pin 122. When the pin 122 is sheared the collet 120 is free to drop down by the force of gravity to place the bosses 120*c adjacent recess 116b* when the collet ring 120*a* engages the nose 118. The fingers 120*b* are sufficiently flexible to enable inward flexing of the bosses 120*c* to enable upward movement past the collar 100 *e* of the lower latching sleeve 100 by flexing the bosses 120*c* inwardly with the tapered shoulder 100*f* of the collar 100*e*. The member 116 forms a shoulder 116*c* above the collar 100*e* to prevent inadvertent upward latching movement of the sleeve 100 during running operations.

The retrieving tool member 114 is formed with a pair of spaced annular releasing recesses 114*d* and 114*e* formed on the member 114 and forming therebetween a locking surface 114*f* and a locking surface 114*g* above the recess 114*d*. A valve locking sleeve 122 is concentrically mounted on the member 114 and is longitudinally movable relative to the member 114. Positioned in a plurality of four windows formed in the sleeve 122 is a corresponding plurality of resilient latching members 124 having upper lugs 124*a* and lower lugs 124*b* projecting outwardly from the sleeve 122. The lugs 124*a* are secured in the outer latching position by the locking surface 114*g* and are received between the downwardly facing seat 72*a* of the frame member 72 and the ball 86 to insure that during installation the ball 86 does not move upwardly into engagement with the seat 72*a* and actuate the detent 96 to move between the spaced shoulders 80*c* and 72*e* which would actuate the stroke compensator and result in the latch dogs being out of registry with the receiving recess in the housing H or the control member 40. The lower outwardly projecting lug 124*b* holds the valve follower 105 in the lower position and assures that the ball does not rotate closed on the portion of the running tool 114 disposed within the bore 86 of the ball 84.

Figure 10A:
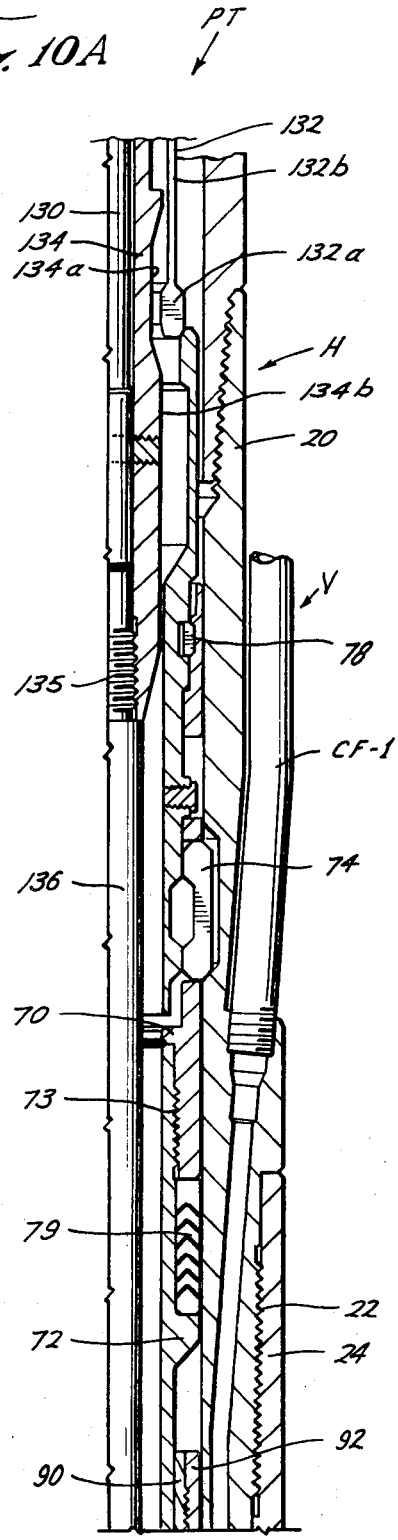
FIGS. 10A and 10B show the valve receiving a retrieving tool for releasing and retrieval of the valve from the tubing retrieval housing.
Figure 10B:
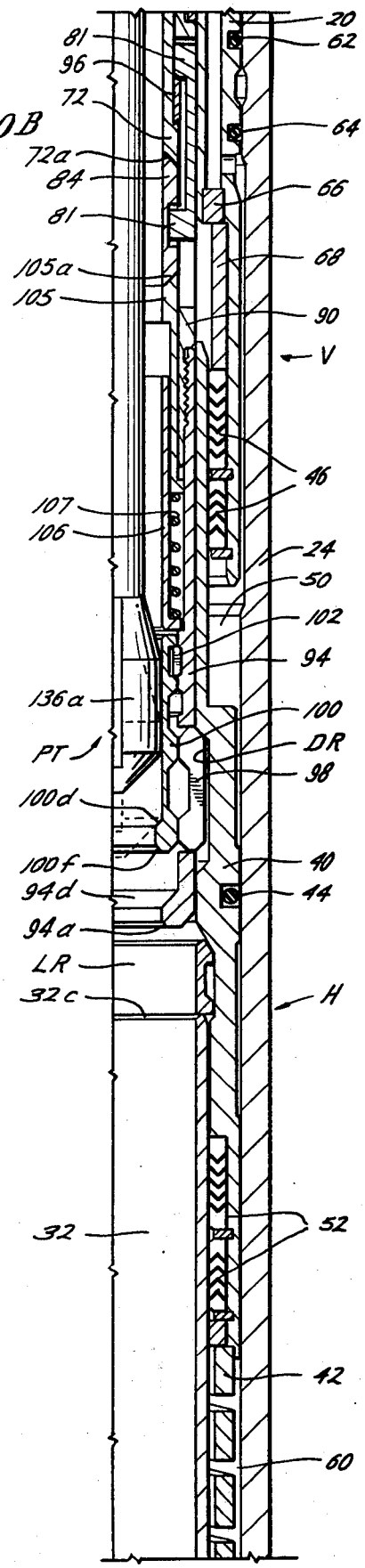

As best illustrated in FIGS. 10A and 10B, a retrieving or pulling tool PT is disclosed for releasing the safety valve V from the housing H and retrieving the valve V back to the surface through the bore of the well tubing T. An upper body of the retrieving tool 130 concentrically mounts a tubular fishing connector tool of standard or known type having a downwardly biased collet 132 concentrically mounted thereon and movable relative thereto. The collet includes a plurality of downwardly projecting resilient fingers 132*a* terminating in enlarged bosses 132*b*. When the bosses 132 engagea restriction in the tubing T when moving to the housing H the collet 132 moves upward to flex the bosses 132 inwardly into a recess 134*a* formed by the collet carrying fishing sleeve 134 above the boss locking sleeve 134*b*. When adjacent the recess 134*a* the collet fingers 132*b* flex inwardly to enable passage of the bosses 132*c* past a movement restriction such as shoulder 76*a*. Once past the shoulder 76*a* the collet fingers 132*b* and the bosses 132*c* will move downwardly relative too the collet carrying member 134 to again be positioned adjacent the locking shoulder 134*b*. When the pulling tool PT moves upwardly the collet is blocked from downward movement and the bosses 132*c* remain on the locking shoulder 134*b* for moving upwardly and engaging the upper shoulder of the latch recess 76*d* for effecting upward movement of the latch sleeve 76 relative to the latch dogs 74 for moving the latch sleeve 76 to the released position and enabling the latch dogs 74 to move radially inwardly to the released position.

The collet carrying member 134 is connected to a rod extension 136 by tubular engagement at 135. At the lower end of the extension 136 is an enlarged head 136*a* dimensioned to pass through the safety valve V to engage the upwardly annular shoulder 100*d* provided by the collar 100*e* of the lower latch sleeve 100. When a downwardly facing annular shoulder 136*b* of the head 136*a* engages the upwardly facing annular shoulder 100*d* the enlarged bosses 132*c* have moved into the unlatching recess 76*d* of the upper latch sleeve. With the downwardly facing annular shoulder 136*a* engaging the upwardly facing shoulder 100*d* the pulling tool PT is jarred downwardly for effecting movement of the operator latch sleeve 100 downwardly from the latched position to the released position and enabling movement of the operator latch dogs 98 to the released position. After jarring downward, the pulling tool PT is pulled upwardly for engaging the operating recess 76*d* of the operator latch sleeve for moving the operator latch sleeve 76 upwardly to release the latch dogs 74. Upon release of the latch dogs 74 the safety valve V is free to move from the housing H upwardly with the pulling tool PT.

OPERATION OF THE PRESENT INVENTION

The housing H and control fluid conduits CF-1 and CF-2 are installed when running the well tubing T and packer P during well completion operations. After connecting the christmas tree X and the automatic controller U it may become desirable to install the subsurface safety valve of the present invention in the housing H. The valve V is assembled on the running tool RT in the manner illustrated in FIGS. 7A and 7B and running tool RT connected with the wireline to enable running from the surface throught the bore of the well tubing T. Increased control fluid pressure is communicated through the conduit CF-1 while the control fluid conduit CF-2 is vented to enable the control member 40 to move down a sufficient distance to radially constrict the landing ring LR to provide a positioning barrier for the valve V as is illustrated in FIG. 7B. When the downwardly facing shoulder 94*a* of the operator sleeve 94 engages the landing ring the latch dogs 98 are positioned adjacent the control member 40 recess DR.

As the safety valve V is mounted on the running tool RT in the stretched condition with the contractable detent 96 positioned adjacent to and outwardly of the collar 72*d* of the frame sleeve 72, the operator sleeves 90 and 94 are in the extended position relative to the frame sleeves 70 and 72 for positioning the frame locking latch dogs 74 adjacent the housing recess HR.

With the safety valve V positioned by the constricted landing ring a downward jar is applied to the member 110 which is transmitted by the sleeve 112 to the shear pin 116 for effecting shearing of the shear in 116 and moving the downwardly facing locking shoulder 112*a* of the member 112 downwardly to engage the upwardly facing locking shoulder 76*x* of the frame latch sleeve 76 for moving the frame latch sleeve 76 to the lower position in setting the dogs 74 in the annular recess HR of the housing. Due to the spacing between the shoulder 112*a* and 76*x* and the longitudinal latching movement distance of the sleeve 76 required to effect latching operation of the latch dogs 74 being substantially the same as the distance between the spaced shoulders 114*c* and 110*b* of the retrieving tool RT the latch sleeve 76 locking operation is effected substantially simultaneous with the shoulders 110*b* and 114*c* of the running tool moving into engagement.

With the upper or frame latch sleeves set for securing the main frame 70 with the housing, the member 110 is moved upwardly by pulling on the wireline and brings the downwardly facing shoulder 114*b* of the enlarged heat 115 into engagement with the upwardly facing shoulder 112*c* of the tubular member 110 for moving the member 110 upwardly. As the resilient finger member lugs 124*a* and 124*b* holds the sleeve 122 against upward movement with the member 115 the recesses 114*d* and 114*e* move upwardly adjacent the projections or lugs 124*a* and 124*b* of the resilient member 124 for releasing the resilient member 124 from holding the ball in the spaced condition from the seat with the lug 124*a* and from rotating the ball with the lug 124*b*. With the lugs 124*a* and 124*b* disposed within the recesses 114*d* and 114*e*, respectively, the sleeve 122 is released to move upwardly to the surface with the running tool RT.

Before release of the resilient members 124 the enlarged bosses 120*c* of the collet 120 are moved into engagement with the downwardly facing annular shoulder 100*f* of the operator latch sleeve and as the running tool RT is moved upwardly the bosses engage the shoulder 100*f* for moving the operator latch sleeve 100 from the lower position to the upper position and radially expanding the latch dogs 98 radially outwardly in the locked condition. When the latch sleeve 100 is in the upper or locking position, the shear pin 122 is sheared enabling the collet 120 to drop downwardly for positioning the bosses 120*c* adjacent the recess 116*b* where the resilient arms 120*b* enable the bosses 126*c* to flex inwardly for passing the collar 100*e* in moving upwardly through the valve V.

Figure 8A:
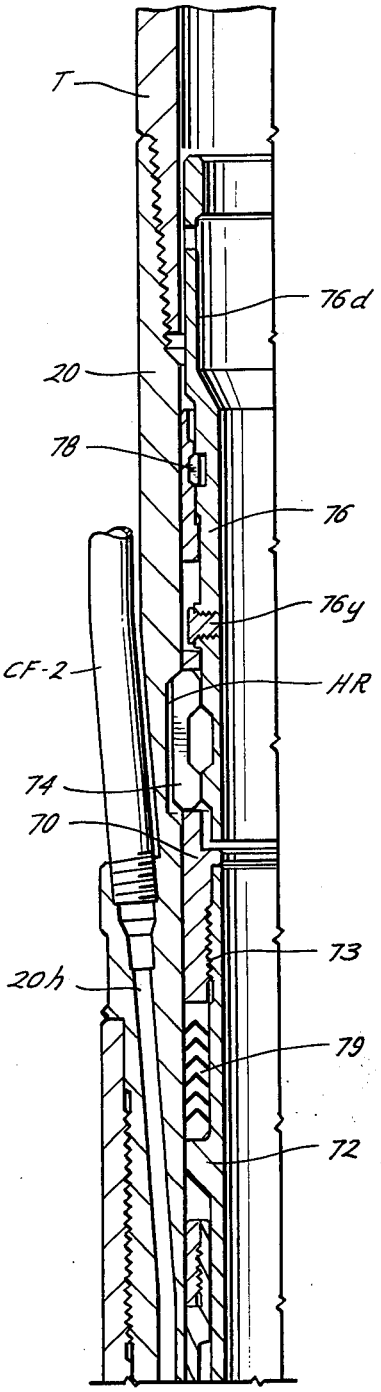
FIGS. 8A and 8B are views similar to FIGS. 7A and 7B illustrating the valve secured in the operating position in the tubing retrievable housing with the valve operated closed.
Figure 8B:
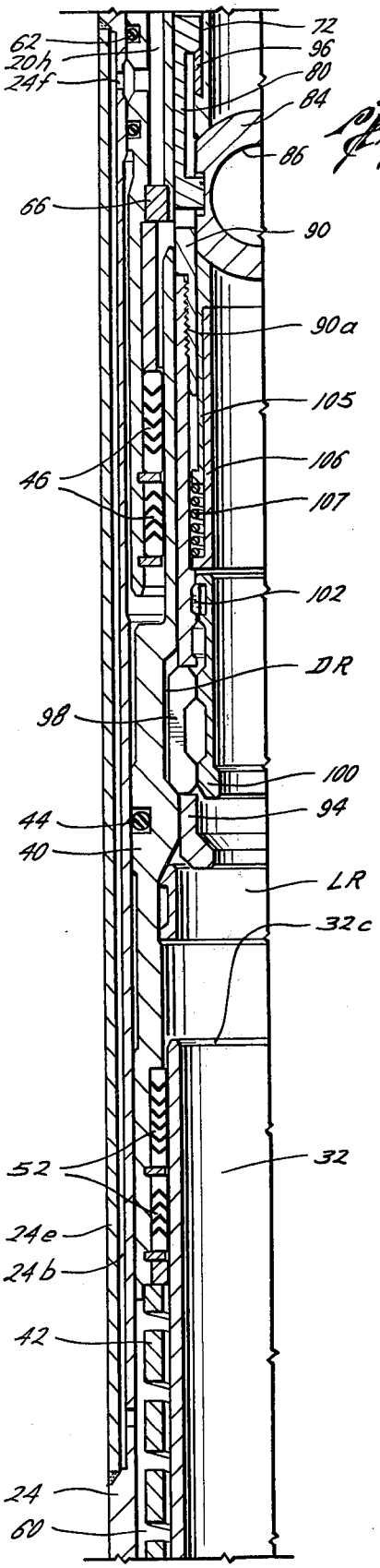

With the running tool removed from the bore TB of the tubing at the surface the control fluid pressure in the conduit CF-1 and expansible chamber 50 is reduced enabling the spring 42 to move the control member 40 upwardly for effecting initial movement of the ball 84 to the closed position (FIGS. 8A and 8B). In moving the ball to the closed position the ball moving member 90 will move the ball 80 to engage the downwardly facing annular seat 72*a* and move the frame connecting member 80 upwardly with the ball to position the ring portion 80*a* above the detent 96 for shortening the operating stroke of the operator means VO for effecting opening and closing rotation of the ball 84. The detent 96 eliminates the slack between the latch dogs 98 and 74 due to the tolerances between the detents and the recesses for receiving them and the manufacturing tolerances in assembling the valve V. In addition, the operator means VO then serves as a lower limit stop for the control member 40 for blocking movement of the control member 40 to actuate the landing ring LR and thus enhance the operating life of the landing ring LR.

Figure 9A:
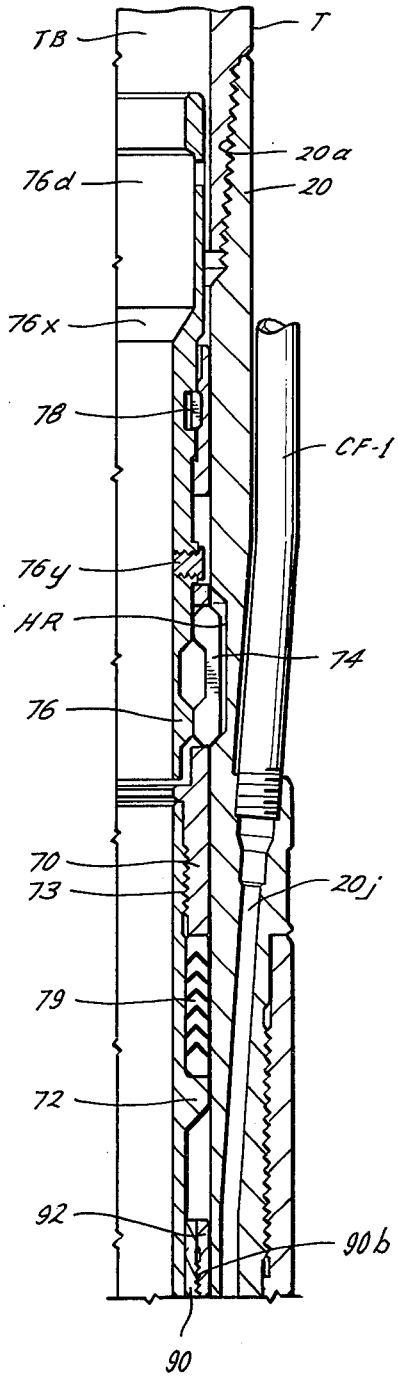
FIGS. 9A and 9B are similar to FIGS. 8A and 8B with the valve operated open.
Figure 9B:
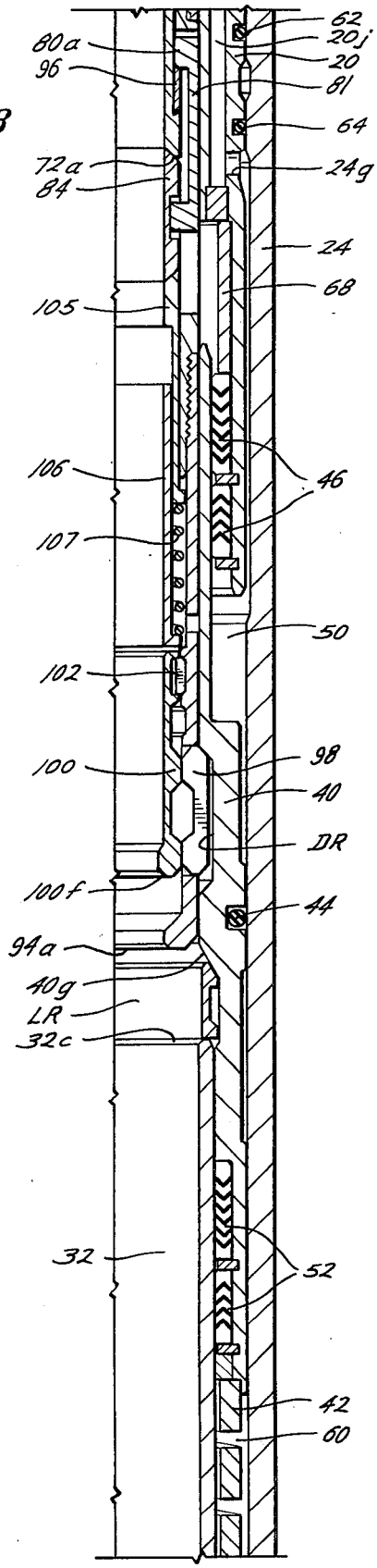

After the initial closing, increased control fluid pressure is communicated through the control fluid conduit CF-1 and into the expansible chamber 50 when desired for holding the control member 40 in the lower position and thereby the ball 84 in the open position for enabling flow (FIGS. 9A and 9B). Should the control fluid pressure in the control fluid conduit CF-1 and chamber 50 be reduced for any reason, such as the sensing of an undesired condition by the surface controller U and venting the control fluid pressure the urging of the spring 42 will effect upward movement of the control member 40 for closing the ball 84. Should the spring 84 fail, increased control fluid pressure may be introduced into expansible chamber 60 with control fluid conduit CF-2 while venting the expansible chamber 50 through control fluid conduit CF-1 to assure upward movement of the control member 40 for closing the ball 84.

When for any reason it becomes desirable to retrieve the subsurface safety valve V from the housing H the running tool illustrated in FIGS. 10A and 10B is lowered on a wireline through the bore of the well tubing. As the downwardly facing shoulder 136*b* of the enlarged head 136*a* engages the upwardly facing shoulder 100*d* of the lower operator latch sleeve 100 for effecting its downward movement to the release position and thereby releasing the latch dogs 98, the retrieving too bosses 132*c* move into the operating recess 76*d* of the latch sleeve 76. After the lower latch sleeve 100 is moved to the release position the pulling tool PT is retrieved by lifting with the wireline and which moves the bosses 132*c* to engage the portion of the operating recess 76*d* while secured on the locking surface 134*b* for pulling the upper latch sleeve 76 to the released position and effecting release of the latch dogs 74 which enables the safety valve V to move upwardly with the pulling tool to the surface S. Should it be desired, another subsurface safety valve V may be installed in the housing H employing the operations previously described.

The foregoing disclosure and description of the invention are illustrative and explanatory thereof, and various changes in the size, shape and materials as well as in the details of the illustrated construction may be made without departing from the spirit of the invention.

I claim:

1. A method for controlling the flow of well fluid through the bore of a well tubing at a desired subsurface location using a controlled safety valve having a valve body and a bore closure means actuated by a movable operator means between open and closed positions for controlling flow of well fluids with the safety valve, comprising the steps of:

moving the safety valve through the bore of the well tubing to the desired subsurface location for securing with the well tubing;

securing the safety valve at the desired subsurface location in the bore of the well tubing against movement through the bore of the well tubing;

actuating the operator means carried by the safety valve for changing the movement limits of the operator means relative to the bore closure means when the safety valve is secured with the well tubing; and operating the bore closure means carried by the safety valve between said open and closed positions by movement of said operator means within said changed limits of movement.

2. The method as set forth in claim 1, wherein the step of actuating includes the step of:

operating the operator means to move the bore closure means from a first installation position to a second operating position for subsequent operation between the open and closed positions.

3. The method as set forth in claim 1, wherein the step of actuating includes the step of:

moving a bore closure member and a seat means into engagement while changing the movement limits of said operator means.

4. The method as set forth in claim 1, wherein the step of securing includes:

securing said safety valve at a first point in said well tubing and at a second point in said well tubing longitudinally spaced from said first point.

5. The method as set forth in claim 4, wherein the step of securing to said first and second points includes:
securing the safety valve body at the first point with the well tubing; and
securing the operator means of the safety valve at the second point.

6. The method as set forth in claim 5, wherein the step of actuating further includes the step of:
eliminating operations movement slack after the step of securing for assuring operation of the bore closure means between the open and closed positions within the changed movement limits of the operator means.

7. The method as set forth in claim 1, wherein the step of operating includes:
rotating a ball member to position an opening formed through said ball member between the open and closed positions.

8. The method as set forth in claim 1, wherein the step of securing includes:
engaging said safety valve with a movable landing stop located at the desired location in said well tubing.

9. The method as set forth in claim 8, wherein said step of actuating includes:
reducing the movement limits of said operator means to space the safety valve from the landing ring to eliminate engagement with the landing ring when said operator means is moved within the reduced movement limits to operate said bore closure means between the open and closed positions.

10. A method for controlling the flow of well fluid through the bore of the well tubing at a desired subsurface location using controlled safety valve having a movable plug co-acting with a seat for controlling flow of well fluids through the bore of the well tubing with the safety valve, comprising the steps of:
moving the safety valve through the bore of the well tubing to the desired subsurface location for securing with the well tubing, and with the safety valve having plug means physically spaced from the valve seat;
securing the safety valve at the desired subsurface location in the bore of the well tubing against movement through the bore of the well tubing;
moving the seat and plug into co-acting operating engagement to control the flow of fluid through the bore of the well tubing; and
actuating a plug movement control system when the seat and plug move into operating engagement for thereafter providing control of the operating movement of the plug to control flow through the bore of the well tubing.

11. The method as set forth in claim 10, wherein the step of actuating includes the step of:
spacing a pair of engagable movement stop shoulders at least a desired distance when the seat and plug move into engagement; and
moving a spacer member between the movement stop shoulders to hold said stop shoulders from thereafter engaging.

12. The method as set forth in claim 11, wherein the step of moving includes the step of:
expanding radially an expansible member between the movement stop shoulders.

13. A method for controlling flow of well fluid through the bore of the well tubing at a desired subsurface location using a controlled safety valve having a movable plug co-acting with a seat for controlling flow of well fluids with a safety valve, comprising the steps of:
securing the safety valve at the desired subsurface location in the bore of the well tubing against movement in the bore of the well tubing;
moving the plug and seat into co-acting operating relationship for blocking flow of well fluids through the bore of the well tubing; and
actuating a plug movement control system for thereafter providing controlled operating movement to the plug to control flow of well fluids through the bore of the well tubing.

14. A method for controlling the flow of well fluid through the bore of the well tubing at a desired subsurface location using a controlled safety valve having a plug co-acting with a seat and movable relative to the seat by a movable operator means for controlling flow of well fluids with a safety valve, comprising the steps of:
securing the safety valve at the desired subsurface location in the bore of the well tubing against movement in the bore of the well tubing;
engaging the plug and seat to co-act for controlling flow of well fluids through the bore of the well tubing; and
actuating means for controlling movement length of the operator means during engagement of the plug with the seat to control flow through the bore of the well tubing.

15. A method for controlling the flow of well fluid through the bore of the well tubing at a desied subsurface location using a surface control safety valve having a movable plug co-acting with a seat of controlling flow of well fluids with a safety valve, comprising the steps of:
securing the safety valve at the desired subsurface location in the bore of the well tubing against movement of the bore of the well tubing;
moving the plug and the seat into co-acting engagement for blocking flow of well fluids through the bore of the well tubing; and
acuating a means for thereafter maintaining a plug in co-acting engagement with the seat during operation of the plug means to control flow through the bore of the well tubing.

16. A method for controlling the flow of well fluid through the bore of the well tubing at a desired subsurface location using a controlled safety valve having a plug operably moved by movement of a controlled operator and co-acting with a seat for controlling flow of well fluids with the safety valve, comprising the steps of:
spacing the safety valve plug and safety valve seat a preselected distance from engagement;
securing the safety valve at the desired subsurface location in the well tubing;
moving the plug and seat into engagement to co-act for controlling flow of well fluids through the bore of the well tubing; and
actuating means for controlling movement of the operator when moving the plug and seat into engagement to compensate for the preselected distance from engagement in operating movement of the operator to thereafter control flow through the bore of the well tubing.

17. A method for controlling the flow of well fluid through the bore of a well tubing at a desired subsurface location using a controlled safety valve having a valve body and a bore closure means actuated by a movable operator means between open and closed positions for controlling flow of well fluids with the safety valve, comprising the steps of:

moving the safety valve through the bore of the well tubing to the desired subsurface location for securing with the well tubing;

securing the valve body safety valve at the desied subsurface location in the bore of the well tubing against movement through the bore of the well tubing;

securing the operator means with a movable control member disposed in the bore of the well tubing at a point longitudinally spaced from the securing of the valve body with the well tubing;

eliminating lost movement slack between the longitudinally spaced points of securing; and operating the bore closure means for controlling flow of well fluid through the bore of the well tubing.

* * * * *